US008499571B2

(12) United States Patent
Saito

(10) Patent No.: US 8,499,571 B2
(45) Date of Patent: Aug. 6, 2013

(54) DRIVE UNIT FOR AUTOMATIC ICE MAKER

(75) Inventor: Shunji Saito, Nagano (JP)

(73) Assignee: Nidec Sankyo Corporation (JP)

( * ) Notice: Subject to any disclaimer, the term of this patent is extended or adjusted under 35 U.S.C. 154(b) by 709 days.

(21) Appl. No.: 12/712,757

(22) Filed: Feb. 25, 2010

(65) Prior Publication Data

US 2010/0218524 A1 Sep. 2, 2010

(30) Foreign Application Priority Data

Feb. 27, 2009 (JP) ..... 2009-045367

(51) Int. Cl.
*F25C 1/00* (2006.01)

(52) U.S. Cl.
USPC ..... 62/135; 62/137; 62/344; 62/345

(58) Field of Classification Search
USPC ..... 62/135, 137, 344, 345
See application file for complete search history.

(56) References Cited

U.S. PATENT DOCUMENTS 5,182,916 A * 2/1993 Oike et al. ..... 62/135
5,735,130 A * 4/1998 Lee ..... 62/71

FOREIGN PATENT DOCUMENTS

JP 8-313132 A 11/1996
JP 2001-304733 A 10/2001

* cited by examiner

*Primary Examiner* — Marc Norman
(74) *Attorney, Agent, or Firm* — Cantor Colburn LLP

(57) ABSTRACT

A drive unit for an automatic ice maker may include a drive part provided with a motor for driving an ice tray and an ice detecting member, a position detecting device for detecting positions of the ice tray and the ice detecting member, a control section for controlling drive of the motor on the basis of detection signals of the position detecting device, and a unit case in which the control section, the drive part, the position detecting device are accommodated. The automatic ice maker may be installed in an ice making compartment of a refrigerator.

5 Claims, 10 Drawing Sheets

PRIOR ART

DRIVE UNIT FOR AUTOMATIC ICE MAKER

CROSS REFERENCE TO RELATED APPLICATION

The present invention claims priority under 35 U.S.C. §119 to Japanese Application No. 2009-45367 filed Feb. 27, 2009, the entire contents of which are incorporated herein by reference.

FIELD OF THE INVENTION

An embodiment of the present invention may relate to a drive unit for an automatic ice maker which is installed in a refrigerator or the like.

BACKGROUND OF THE INVENTION

An automatic ice maker which is mounted on a refrigerator such as a household refrigerator includes an ice tray, an ice detecting member and a drive unit. The drive unit is provided with a position detecting device for detecting positions of the ice tray and the ice detecting lever and a drive part for driving the ice tray and the ice detecting member within a unit case (see Japanese Patent Laid-Open No. Hei 8-313132 and Japanese Patent Laid-Open No. 2001-304733).

As shown in FIG. 12, a refrigerator provided with the automatic ice maker described above has been conventionally mounted with a control circuit 190X in a refrigerator main body 100X for controlling the entire refrigerator including the automatic ice maker 1X. Therefore, the control circuit 190X outputs control signals to the automatic ice maker 1X based on detection results of a temperature of the ice tray, a position of the ice tray or the ice detecting member obtained by using a position detecting device and the like which are outputted from the automatic ice maker 1X. In this manner, a water supply device and a motor 13 provided in the drive part of the automatic ice maker 1X are controlled so that water supply to the ice tray, detection of an ice quantity in an ice storage part, an ice separating operation from the ice tray and the like are performed. Accordingly, the automatic ice maker 1X and the refrigerator main body 100X are electrically connected with each other through a wiring group 59 and a connector 590.

However, in the structure shown in FIG. 12, when the automatic ice maker 1X is to be installed into a refrigerator where the automatic ice maker 1X is not mounted or, when an existing automatic ice maker 1X is to be exchanged for another automatic ice maker 1X whose specification is different, the control circuit 190X which is mounted on the refrigerator main body 100X is required to be changed.

SUMMARY OF THE INVENTION

In view of the problem described above, at least an embodiment of the present invention may advantageously provide a drive unit for an automatic ice maker which is capable of being installed or replaced without changing a control circuit of a refrigerator main body.

According to at least an embodiment of the present invention, there may be provided a drive unit for an automatic ice maker including a drive part provided with a motor for driving an ice tray and an ice detecting member, a position detecting device for detecting positions of the ice tray and the ice detecting member (an ice tray position detecting means and an ice detecting member position detecting means), a control section for controlling the motor on the basis of a detection signal of the position detecting device, and a unit case in which the control section, the drive part and the position detecting device are accommodated.

In accordance with an embodiment of the present invention, in a drive unit for an automatic ice maker, a control section is also accommodated within a unit case in which a drive part and a position detecting device are accommodated. Therefore, when an automatic ice maker is to be installed in a refrigerator in which an automatic ice maker is not mounted or, when an existing automatic ice maker is to be exchanged for an another automatic ice maker whose specification is different, a control circuit mounted on the refrigerator main body is not required to be changed. Accordingly, the automatic ice maker can be installed or replaced without changing a control section of the refrigerator main body. Further, a large number of control signals are not required to give and receive between the automatic ice maker and the refrigerator main body. Therefore, basically, the automatic ice maker and the refrigerator main body may be required to be connected with each other only through wiring lines for power supply and thus electric connections between the automatic ice maker and the refrigerator main body can be simplified. For example, it may be structured that the automatic ice maker is installed in an ice making compartment of a refrigerator, and a drive voltage and a ground potential are supplied to the drive unit from a refrigerator main body of the refrigerator through a connector provided in the automatic ice maker. Further, specifically, it may be structured that the drive part includes a cam wheel which is to be connected to the ice tray for reversing the ice tray, an ice detecting shaft which is operated by the cam wheel to operate the ice detecting member, and a drive gear train which is connected with the motor for driving the cam wheel and the ice detecting shaft. An ice tray position detecting means and an ice detecting member position detecting means is comprised of a push switch which is operated by the cam wheel, and the cam wheel, the ice detecting shaft, the drive gear train, the motor and the push switch are accommodated within the unit case. In addition, a circuit board with which the motor and terminals of the push switch are connected is also accommodated within the unit case and the control section is mounted on the circuit board.

In accordance with an embodiment of the present invention, wiring lines which are connected to a thermistor for detecting a temperature of the ice tray are connected to an inside of the unit case, and the control section controls the drive of the motor on the basis of the detection signal of the position detecting device, i.e., the detection signals of the ice tray position detecting means and the ice detecting member position detecting means and a detection signal of the thermistor. According to this structure, even when a drive of the motor is controlled on the basis of a detection signal of the thermistor, a control circuit mounted on the refrigerator main body is not required to be changed. Further, since the thermistor is disposed in the vicinity of the ice tray, the thermistor is disposed at a position nearer to the unit case than the control circuit of the refrigerator main body. Therefore, when the wiring lines connected with the thermistor are connected to the unit case, lengths of the wiring lines are remarkably shortened. Specifically, it may be structured that wiring lines which are connected to the thermistor are connected to the control section provided in a circuit board within the unit case, and a signal of the push switch and a detection signal of the thermistor are inputted into the control section without going through a control circuit of the refrigerator main body of the refrigerator and the motor is controlled by the control section.

In accordance with an embodiment of the present invention, wiring lines which are connected to a liquid supply device for supplying liquid to the ice tray are connected to an inside of the unit case, and the control section controls the liquid supply device. According to this structure, even when a liquid supply device is installed, a control circuit provided in the refrigerator main body is not required to be changed. Further, since the liquid supply device is disposed in the vicinity of the ice tray, the liquid supply device is disposed at a position nearer to the unit case than the control circuit of the refrigerator main body. Therefore, when wiring lines connected with the liquid supply device are connected to the unit case, lengths of the wiring lines are remarkably shortened. Specifically, it may be structured that wiring lines which are connected to the liquid supply device are connected to the control section which is provided in a circuit board within the unit case, and the control section directly controls the liquid supply device without going through a control circuit of the refrigerator main body.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

A drive unit for an automatic ice maker in accordance with an embodiment of the present invention will be described below with reference to the accompanying drawings.

Figure 1:
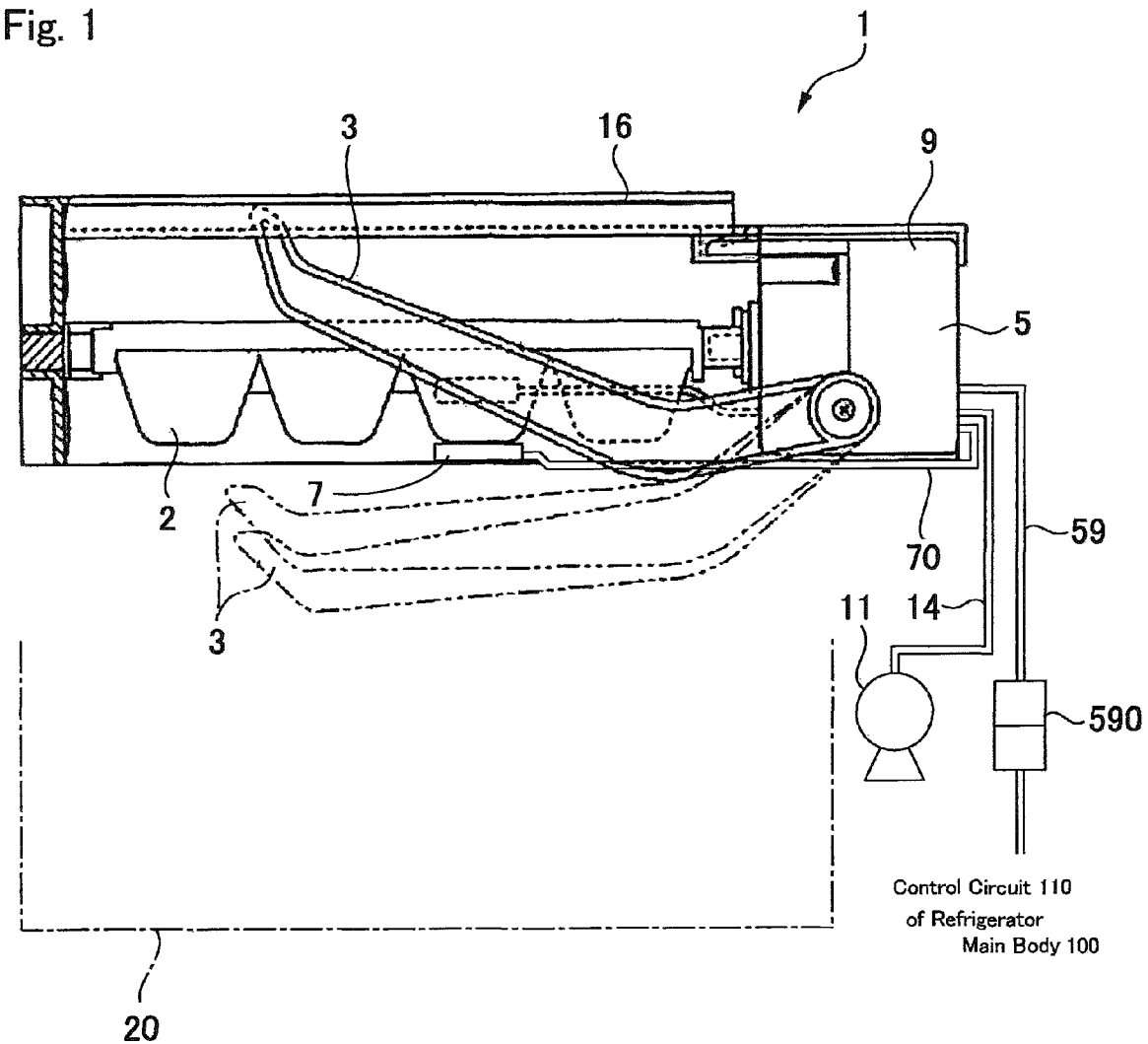
FIG. 1 is an explanatory view showing a structure of an automatic ice maker in accordance with an embodiment of the present invention.

FIG. 1 is an explanatory view showing a structure of an automatic ice maker to which the present invention is applied. An automatic ice maker 1 shown in FIG. 1 is a device which automatically performs an ice making operation and an ice separating operation and the automatic ice maker 1 is installed in an ice making compartment of a refrigerator. The automatic ice maker 1 includes an ice tray 2 which is disposed on an upper side of an ice storage part 20, an ice detecting member 3 which is formed in a lever-like shape for detecting an ice storage quantity in the ice storage part 20, a water-supply pump 11 (liquid supply device) for supplying water into the ice tray 2, and a drive unit 5 for driving the ice tray 2 and the ice detecting member 3 in an interlocked manner. Further, the automatic ice maker 1 is provided with a thermistor 7 which detects a temperature of the ice tray 2 for monitoring whether an ice making operation has ended or not.

In the automatic ice maker 1 described above, the ice tray 2 is reversed by the drive unit 5 to drop ice pieces into the ice storage part 20 from the ice tray 2. When the ice separating operation is to be performed, a protruded part (not shown) provided on the ice tray 2 is abutted with an abutting piece (not shown) which is provided in a refrigerator main body or a frame 16 of the automatic ice maker 1 to cause the ice tray 2 to be reversed and to occur twisted deformation and ice pieces are dropped. Further, the drive unit 5 makes the ice detecting member 3 move up and down as shown by the two-dot chain lines and an ice quantity in the ice storage part 20 is detected.

Figure 2:
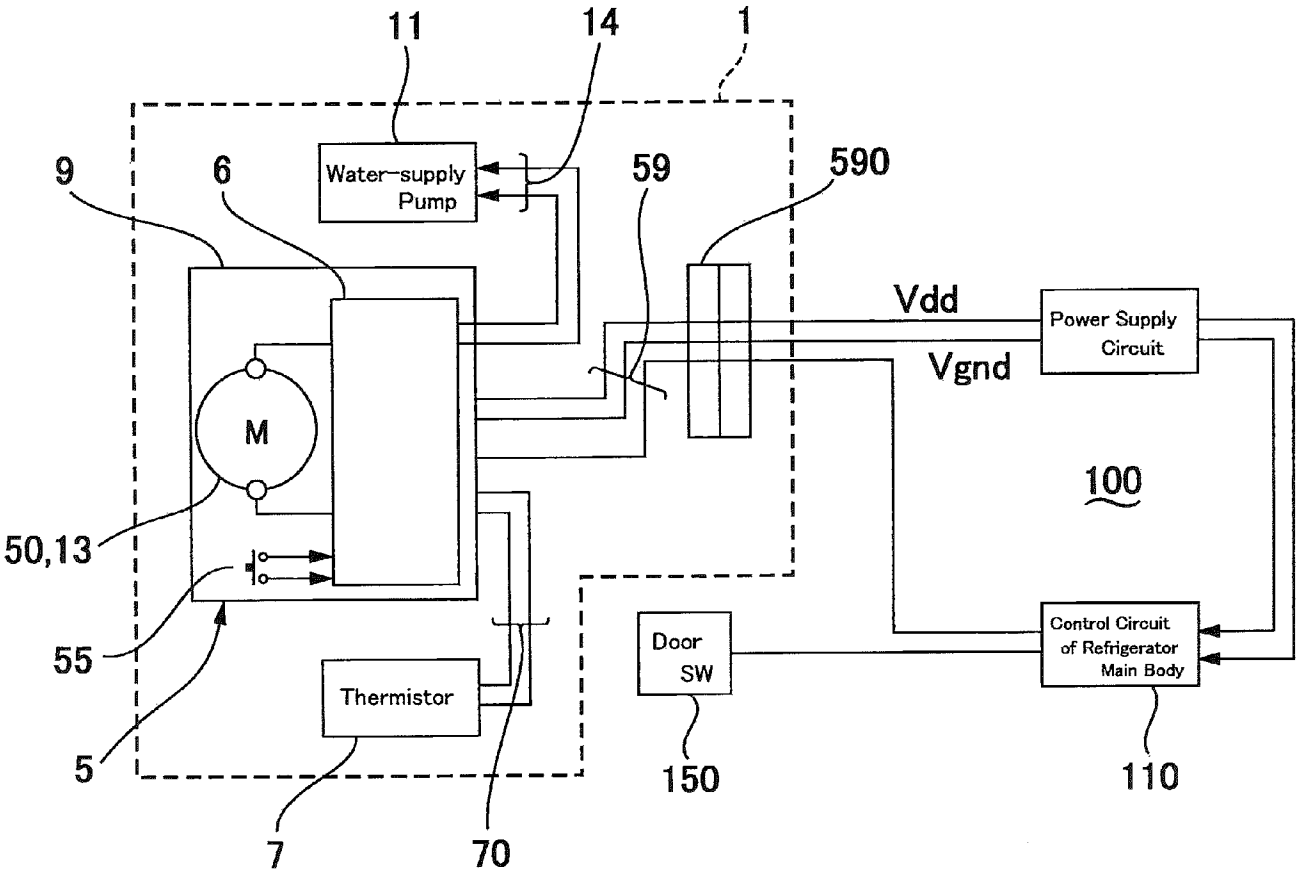
FIG. 2 is an explanatory block diagram showing an electric connection and the like between a drive unit for an automatic ice maker in accordance with an embodiment of the present invention and a refrigerator main body.

FIG. 2 is an explanatory block diagram showing an electric connection and the like between a drive unit for an automatic ice maker to which the present invention is applied and a refrigerator main body.

As shown in FIGS. 1 and 2, the drive unit 5 includes a drive part 50 provided with a motor 13 for driving the ice tray 2 and the ice detecting member 3, a position detecting device 55 having both functions as an ice tray position detecting means for detecting the position of the ice tray 2 and as an ice detecting member position detecting means for detecting the position of the ice detecting member 3, and a unit case 9. The drive part 50 and the position detecting device 55 are disposed in the inside of the unit case 9. The position detecting device 55 functions as a tact switch which is turned on and off in correspondence with moving positions and the like of the ice tray 2 and the ice detecting member 3. The position detection signal which is outputted from the position detecting device 55 is inputted into a control section 6.

The drive unit 5 and a refrigerator main body 100 are electrically connected with each other through an wiring group 59 extended from the drive unit 5 and a connector 590 provided at an end part of the wiring group 59. A drive voltage "Vdd" of, for example, DC12V and a ground potential "Vgnd" are supplied from the refrigerator main body 100 to the drive unit 5 through the wiring group 59 and the connector 590.

In the automatic ice maker 1 in this embodiment, a control section 6 for controlling the entire automatic ice maker 1 including the control of the motor 13 is separately structured from a control circuit 110 for the refrigerator main body 100.

The control section 6 is accommodated in the inside of the unit case 9 of the drive unit 5. Therefore, wiring lines 70 connected with the thermistor 7 are connected with the control section 6 provided within the unit case 9, and a detection result of the thermistor 7 is directly inputted into the control section 6 without going through the refrigerator main body 100. Further, in this embodiment, wiring lines 14 connected with the water-supply pump 11 are also connected with the control section 6 provided within the unit case 9. The control section 6 directly controls the water-supply pump 11 as a liquid supply device without going through the refrigerator main body 100. The wiring lines 14 are power lines for the water-supply pump 11 and the water-supply pump 11 is driven by the control section 6.

Therefore, the wiring group 59 which electrically connect the drive unit 5 with the refrigerator main body 100 includes wiring lines for supplying the drive voltage "Vdd" and the ground potential "Vgnd" but does not include wiring lines for the motor 13, wiring lines for the thermistor 7, and wiring lines for the water-supply pump 11.

In this embodiment, a door switch 150 is provided in the refrigerator main body 100 for monitoring an open-and-close of a door of the refrigerator and, when the door is opened, the drive of the ice detecting member 3 and the drive of the ice tray 2 in the automatic ice maker 1 are stopped. Therefore, a detection signal of the door switch 150 is supplied to the automatic ice maker 1 through the control circuit 110 of the refrigerator main body 100. Therefore, the wiring group 59 includes a wiring line for supplying a door open-and-close signal which is a detection signal of the door switch 150 and is supplied to the drive unit 5 from the refrigerator main body 100.

Figure 3:
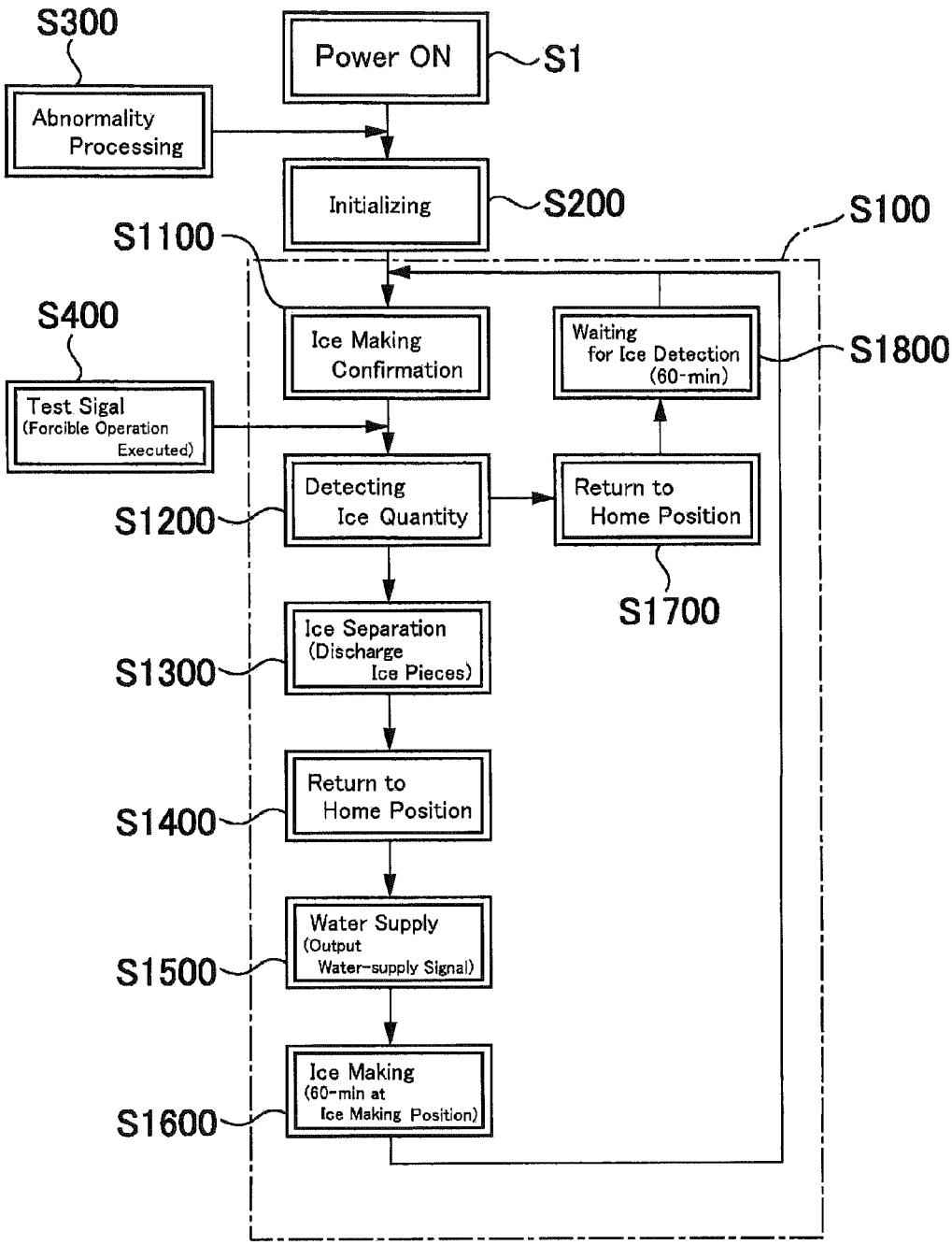
FIG. 3 is a flow chart showing an operation of an automatic ice maker in accordance with an embodiment of the present invention.

FIG. 3 is a flow chart showing a basic operation of the automatic ice maker 1 to which the present invention is applied. In the automatic ice maker 1 in this embodiment, the control section 6 is structured of a microcomputer, a memory, a timer and the like. The control section 6 executes a processing which will be described below with reference to FIG. 3 based on an operation program previously stored in the memory.

As shown in FIG. 3, in the step "S1", when a power supply of the automatic ice maker 1 is turned on, first, in the step "S200", an initialize step in which the ice tray 2 and the ice detecting member 3 are returned to their home positions is executed in the automatic ice maker 1 and, after that, a basic operation is executed in the step "S100". When supply of electric power is restarted after supply of electric power to the drive unit 5 has been interrupted due to a trouble such as power failure during an operation of the automatic ice maker 1, the positions of the ice tray 2 and the ice detecting member 3 are unable to be recognized. Therefore, when power supply of the automatic ice maker 1 is turned on, the initialize step is executed first.

In the basic operation of the automatic ice maker 1 in this embodiment, first in the step "S1100", an ice making confirming step is executed in which it is judged whether the ice tray 2 has reached below a predetermined temperature or not on the basis of a signal outputted from the thermistor 7. Next, in the step "S1200", an ice detecting step is performed in which the ice detecting member 3 is driven by the motor 13 to check and confirm whether a sufficient quantity of ice pieces are stored in the ice storage part 20 or not. In the ice detecting step, a tip end of the ice detecting member 3 is moved down into the inside of the ice storage part 20 and an ice quantity in the ice storage part 20 is detected on the basis of its downward moving distance.

In the ice detecting step, when it is judged that a sufficient amount of ice pieces is stored in the ice storage part 20, in the step "S1700", a home position returning step is executed in which the ice detecting member 3 is returned to the home position by the motor 13 and, after that, in the step "S1800", an ice detection waiting step is executed and, after that, the ice making confirming step is executed again in the step "S1100".

On the other hand, when it is judged that an ice quantity in the ice storage part 20 is not sufficient in the ice detecting step in the step "S1200", the ice tray 2 is driven by the motor 13 to discharge ice pieces from the ice tray 2 into the ice storage part 20 in an ice separation operating step in the step "S1300". In the ice separation operating step, the ice tray 2 is reversed and twisted to be located at an ice separating position to drop ice pieces into the ice storage part 20.

Next, the home position returning step in which the ice tray 2 is returned to the home position is executed in the step "S1400" and, after that, the water-supply pump 11 is driven in the step "S1500" and a water-supply operating step in which water is supplied to the ice tray 2 is executed. And then, an ice making step is executed in the step "S1600".

In this embodiment, in a case that an ice making operation is not performed, for example, in a case that a test after assembling or the like is performed, when a forcible operation execution command is issued in the step "S400", the ice detecting step in the step "S1200" is executed.

Further, when a door of the refrigerator is operated in the refrigerator main body 100 in the middle of the above-mentioned operation, an abnormality processing step in the step "S300" is executed and, after that, the initialize step in the step "S200" is executed.

As described above, in the drive unit 5 for the automatic ice maker 1 in this embodiment, the unit case 9 into which the drive part 50 and the position detecting device 55 are accommodated is also accommodated with the control section 6. Therefore, a large number of control signals is not required to be transmitted between the automatic ice maker 1 and the refrigerator main body 100. Further, in a case that an automatic ice maker 1 is to be assembled into a refrigerator which has not installed with an automatic ice maker 1 yet or, in a case that an existing automatic ice maker 1 is to be exchanged for another automatic ice maker 1 whose specification is different, the control circuit 110 mounted on the refrigerator main body 100 is not required to be changed, and mounting or replacement of an automatic ice maker 1 is performed without changing the control circuit 110 of the refrigerator main body 100.

Further, a large number of control signals is not required to be transmitted between the automatic ice maker 1 and the refrigerator main body 100 and thus, basically, only wiring lines for power supply are required to be connected between the automatic ice maker 1 and the refrigerator main body 100 and thus electric connection between the automatic ice maker 1 and the refrigerator main body 100 can be simplified.

In addition, the wiring lines 70 connected with the thermistor 7 for detecting a temperature of the ice tray 2 are connected to the inside of the unit case 9 and the control section 6 controls drive of the motor 13 based on a detection signal of the position detecting device 55 and a detection signal of the thermistor 7. Therefore, even when the drive of the motor 13 is controlled on the basis of a detection signal of the thermistor 7, the control circuit 110 of the refrigerator main body 100 is not required to be changed. Further, since the thermistor 7 is disposed in the vicinity of the ice tray 2, the thermistor 7 is disposed at a position nearer to the unit case 9 than the control circuit 110 of the refrigerator main body 100.

Therefore, when the wiring lines 70 connected with the thermistor 7 are connected to the unit case 9, lengths of the wiring lines 70 are remarkably shortened.

In addition, the wiring lines 14 connected with the water-supply pump 11 as a liquid supply device for supplying water to the ice tray 2 are connected to the unit case 9. Therefore, even when the water-supply pump 11 is installed, the control circuit 110 of the refrigerator main body 100 is not required to be changed. Further, since the water-supply pump 11 is disposed in the vicinity of the ice tray 2, the water-supply pump 11 is disposed at a position nearer to the unit case 9 than the control circuit 110 of the refrigerator main body 100. Therefore, when the wiring lines 14 connected with the water-supply pump 11 are connected to the unit case 9, lengths of the wiring lines 14 are remarkably shortened. In accordance with an embodiment of the present invention, it may be structured so that an electromagnetic valve is used as a liquid supply device for supplying water to the ice tray 2 and that a flow passage of water is controlled to be opened or closed by the electromagnetic valve. In this case, when wiring lines 14 connected to the electromagnetic valve is connected to the inside of the unit case 9, lengths of the wiring lines 14 can be remarkably shortened.

Figure 4:
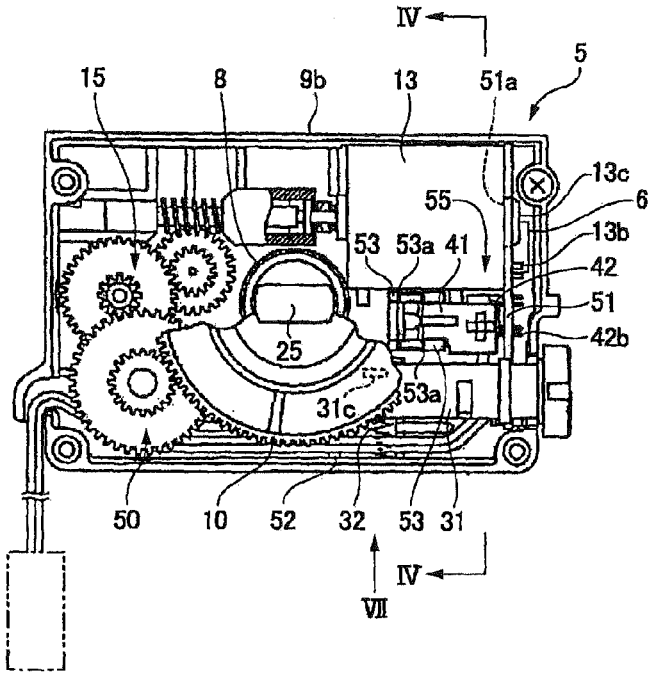
FIG. 4 is a front view showing an inside structure of the drive unit for the automatic ice maker shown in FIG. 1 in which one of case members structuring a unit case is detached.

FIG. 4 is a front view showing an inside structure of the drive unit in the automatic ice maker shown in FIG. 1 in which one of case members structuring the unit case is detached.

Figure 5:
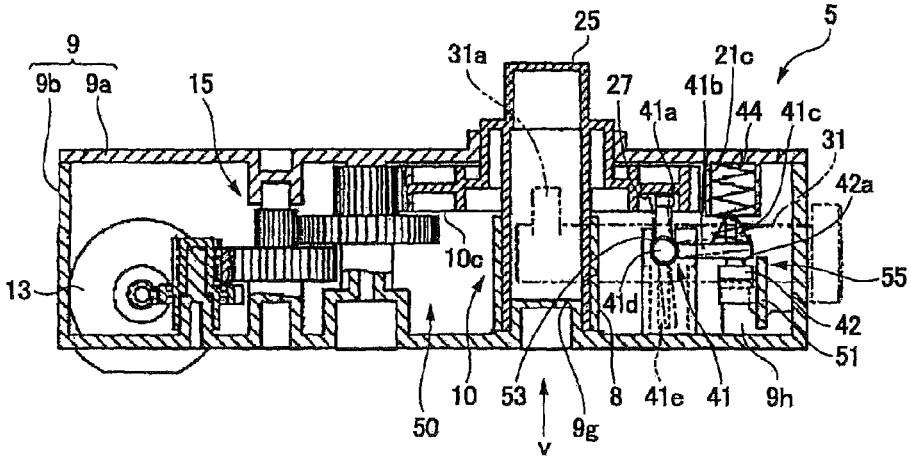
FIG. 5 is a cross sectional development view showing a connecting relationship of a drive gear train in the drive unit shown in FIG. 4.
Figure 6:
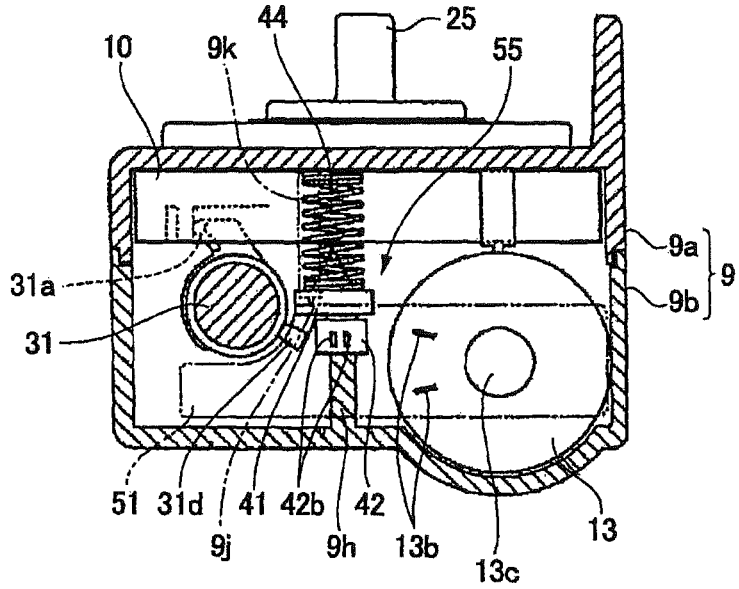
FIG. 6 is a cross-sectional view showing the drive unit which is cut by the arrow "IV-IV" in FIG. 4.

FIG. 5 is a cross sectional development view showing a connecting relationship of a drive gear train of the drive unit shown in FIG. 4. FIG. 6 is a cross-sectional view showing the drive unit which is cut by the arrow "IV-IV" in FIG. 4.

As shown in FIGS. 4 and 5, the drive unit 5 is provided with a drive part 50 for driving the ice tray 2 and the ice detecting member 3. The drive part 50 includes a cam wheel 10 which is to be connected with the ice tray 2 for reversing the ice tray 2, an ice detecting shaft 31 which is operated by the cam wheel 10 for moving the ice detecting member 3, and a motor 13 as a drive source which is connected with the cam wheel 10 and the ice detecting shaft 31 through a drive gear train 15.

The drive unit 5 is provided with a position detecting device 55 for detecting a turning position of the ice tray 2 and the ice detecting shaft 31 (ice detecting member 3). The position detecting device 55 is provided with a push switch 42 for detecting a detection result for a quantity of ice pieces by the ice detecting member 3, and a pressing member 41 for setting the push switch 42 in a pressing/non-pressing state.

The drive part 50 and the position detecting device 55 are accommodated at predetermined positions within the unit case 9. The unit case 9 is comprised of two case members 9*a* and 9*b*. The inside of the unit case 9 is accommodated with a circuit board 51 to which respective terminals of the motor 13 and the push switch 42 are connected. Further, a bearing bushing 13*c* which rotatably supports an output shaft of the motor 13 is fitted into a hole 51*a* formed in the circuit board 51. The push switch 42 is disposed between the motor 13 and the ice detecting shaft 31. Motor terminals 13*b* provided on an end face on a rear side of the motor 13 and terminals 42*b* protruded in a side direction of the push switch 42 are connected with the circuit board 51 which is disposed to be parallel to the side wall of the unit case 9.

A semiconductor IC (Integrated Circuit) structuring the control section 6 shown in FIG. 2 is mounted on the circuit board 51 and the control section 6 is accommodated in the unit case 9. The wiring group 59 and the wiring lines 14 and 70 which are described with reference to FIGS. 1 and 2 are connected with the circuit board 51.

As shown in FIG. 6, the push switch 42 is disposed within the drive unit 5 so that a protruded part 9*h* stood from a bottom part of the case member 9*b* is directly abutted with a surface on an opposite side of the push switch 42 to a contact face with the pressing member 41. The push switch 42 is pressed toward the back side of the paper surface in FIG. 4 by the pressing member 41. However, the protruded part 9*h* which supports the push switch 42 is stood from the bottom face of the case member 9*b* on the back side of the push switch 42. In other words, the push switch 42 is mounted on the circuit board 51 so that a board face of the circuit board 51 is parallel to a pressing direction of the pressing member 41 which presses the push switch 42. The rear end face of the push switch 42 is disposed so as to be directly abutted with the upper end face of the protruded part 9*h*. A switch-pressing operation preventing piece 31*d* of the ice detecting shaft 31 is capable of directly abutting with a pressing side face of the pressing member 41 against the push switch 42.

Figure 7:
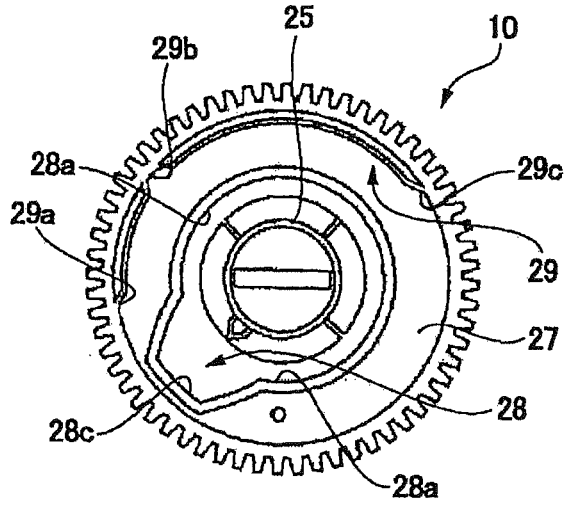
FIG. 7 is a bottom view showing a cam wheel used in the drive unit which is viewed in the arrow "V" direction in FIG. 5.

FIG. 7 is a bottom view showing the cam wheel 10 used in the drive unit 5 which is viewed in the arrow "V" direction in FIG. 5. The cam wheel 10 shown in FIGS. 4 and 7 is turned by the motor 13 which is a drive source. An output shaft 25 is integrally formed to the cam wheel 10. The output shaft 25 is protruded to the outside of the drive unit 5 from a hole formed in the case member 9*a* to be connected with the ice tray 2. Therefore, the cam wheel 10 and the ice tray 2 are integrally turnable together with each other. An end part on an opposite side of the output shaft 25 which is not connected with the ice tray 2 is formed in a tube shape and the end part is turnably supported by a circular support part 9*g* which is formed in the case member 9*b*.

Figure 8:
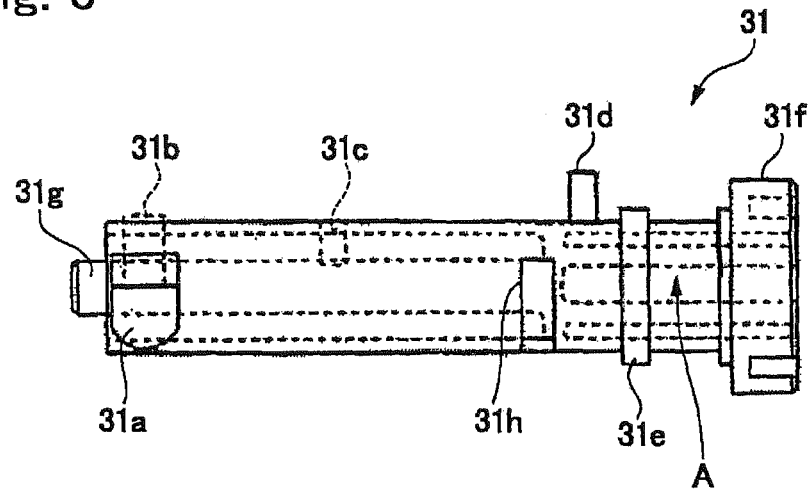
FIG. 8 is a front view showing an ice detecting shaft in the drive unit in FIG. 4.
Figure 9:
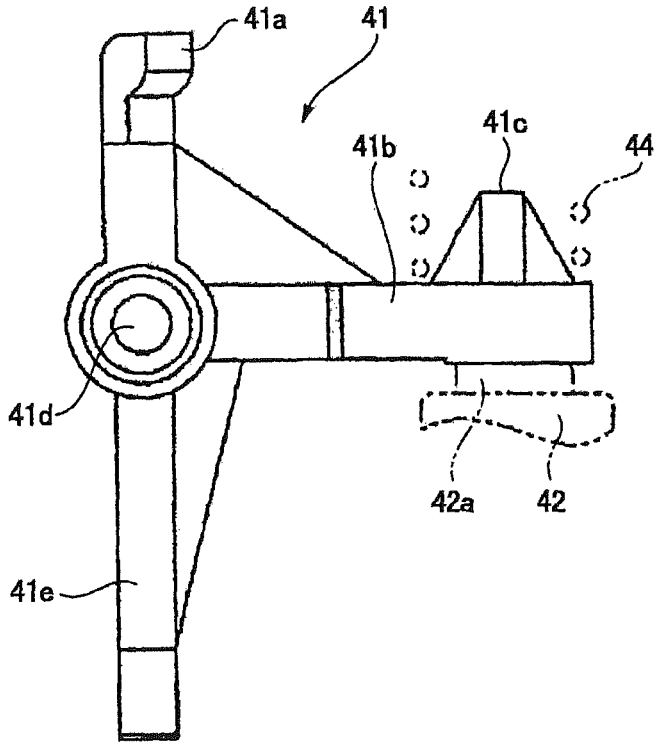
FIG. 9 is a bottom view showing a pressing member in the drive unit which is viewed in the arrow "VII" direction in FIG. 4.

FIG. 8 is a front view showing the ice detecting shaft 31 in the drive unit 5 in FIG. 4. FIG. 9 is a bottom view showing the pressing member 41 in the drive unit 5 which is viewed in the arrow "VII" direction in FIG. 4. As shown in FIGS. 4 and 5, a tube-shaped friction member 8 is loosely and frictionally engaged with an outer peripheral face of an end part of the output shaft 25. An outer peripheral face of the friction member 8 is formed with a turning preventing piece (not shown) for preventing turning of the ice detecting shaft 31 at an ice detecting position when driven in a direction to the ice making position (turning direction opposite to the direction of the ice separating position where ice pieces are dropped from the ice tray 2). When the friction member 8 is turned in the direction toward the ice making position together with the cam wheel 10, the turning preventing piece is moved to a position where the turning preventing piece is engaged with an engagement piece 31*b* of the ice detecting shaft 31 and thus the turning preventing piece is engaged with the engagement piece 31*b*. Therefore, in a case that the cam wheel 10 is driven in the direction toward the ice making position, even when an engagement protruded part 31*a* of the ice detecting shaft 31 is faced to an ice shortage detecting part 28*c* of a cam face 28 for ice detecting shaft of the cam wheel 10 (see FIG. 7), the turning of the ice detecting shaft 31 is prevented by the turning preventing piece described above and thus the ice detecting shaft 31 is not turned and does not follow the cam face shape. Accordingly, when the ice detecting shaft 31 is located at the ice detecting position, the switch-pressing operation preventing piece 31*d* formed on the ice detecting shaft 31 does not prevent turning of the pressing member 41 for pressing the push switch 42 and thus the push switch 42 is turned on. In other words, at the time of turning of the ice tray 2 after the ice separating operation has ended, an urging force of the coil spring 44 is applied to the pressing member 41 to turn the pressing member 41 at the ice detecting position and thus the push switch 42 is turned on regardless of the ice quantity in the ice storage part 20.

On the other hand, when the friction member 8 is turned in the direction toward the ice separating position together with the cam wheel 10, the turning preventing piece of the friction member 8 is moved to a position deviated from the turning range of the engagement piece 31*b* of the ice detecting shaft 31 and thus the turning preventing piece is not engaged with the engagement piece 31*b*. Therefore, the ice detecting shaft 31 is capable of freely turning so as to follow a concaved shape of the cam face 28 for ice detecting shaft as described below at the ice detecting position.

In this embodiment, as shown in FIGS. 5 and 7, a ring-shaped recessed part 27 is formed on a side face 10*c* of the cam wheel 10 which faces the case member 9*b*. The recessed part 27 is formed with a cam face 28 for ice detecting shaft so that its inner side wall is formed as a cam face and a cam face 29 for pressing member so that its inner side wall is also formed as a cam face on an outer side of the cam face 28. The cam face 28 for ice detecting shaft and the cam face 29 for pressing member are formed on inner peripheral faces of side walls of extended parts which are formed so as to be substantially parallel to a turning center axis of the cam wheel 10. In addition, as shown in FIG. 7, the cam face 28 for ice detecting shaft is provided with an ice detection non-operating part 28*a* and an ice shortage detecting part 28*c*. The ice detection non-operating part 28*a* is a region where the ice detecting member 3 is maintained in a state that the ice detecting member 3 is not moved downward. Further, the ice shortage detecting part 28*c* is a region where the ice detecting member 3 is maintained in a state that the ice detecting member 3 is moved to the lowest position when ice pieces are insufficient. The ice shortage detecting part 28*c* is formed in a concaved shape. The ice detecting shaft 31 is urged by an urging force of the coil spring 32 whenever the engagement protruded part 31*a* is fitted to the ice shortage detecting part 28*c*.

Further, as shown in FIG. 7, the cam face 29 for pressing member is provided with a first cam part 29*a* for generating a first signal to output a signal at the ice making position, a second cam part 29*b* for generating a second signal to output a signal at the ice detecting position, and a cam part 29*c* for generating a third signal to output a signal at the ice separating position. These cam parts 29*a*, 29*b* and 29*c* for generating signals are respectively formed in concaved shapes. The pressing member 41 is urged by the urging force of the coil spring 44 to be turned toward the push switch 42 whenever the cam abutting part 41*a* is fitted to these concaved portions. In this embodiment, when the ice detecting shaft 31 is turned over a predetermined angle or more, the switch-pressing operation preventing piece 31*d* formed on the ice detecting shaft 31 prevents turning of the pressing member 41 for pressing the push switch 42 as described below. In this manner, when the turning angle of the cam wheel 10 is located at the ice making position and the ice separating position, in other words, when the ice tray 2 is positioned in a horizontal state for making ice pieces and when the ice tray 2 is reversed to be twisted for dropping ice pieces, the push switch 42 is turned on. In addition, the push switch 42 outputs an ice detecting signal when ice pieces are detected to be in a full state by an ice detecting operation and when the ice detecting position is passed at the time driven in a direction toward the ice making position after the ice separating operation has ended. As described above, in this embodiment, the push switch 42 outputs a signal of an ice detecting result and a signal for detecting a position of the ice tray 2.

According to the structure as described above, when the ice tray 2 is turned in the direction toward the ice separating position and when ice pieces in the ice storage part 20 are in an insufficient state, the ice detecting shaft 31 is turned more than the predetermined angle and the push switch 42 is not turned on (not pressed). On the other hand, when ice pieces are stored with a sufficient quantity in the ice storage part 20, the ice detecting member 3 is abutted with the ice pieces in the ice storage part 20 and thus the ice detecting shaft 31 cannot be turned more than the predetermined angle. Therefore, the engagement piece 31*b* of the ice detecting shaft 31 cannot prevent the turning of the pressing member 41. Accordingly, in this case, the pressing member 41 is turned by the urging force of the coil spring 44 to depress the push switch 42 at the ice detecting position.

In this embodiment, the ice detecting shaft 31 is operated by the cam wheel 10 and is turnable up to the maximum angle of 35 degrees. As shown in FIG. 8, the ice detecting shaft 31 is provide with an engagement protruded part 31*a*, an engagement piece 31*b*, a spring engagement part 31*c*, a switch-pressing operation preventing piece 31*d*, a thrust detachment prevention ring part 31*e* formed over the entire periphery, a lever connecting part 31*f*, a case support part 31*g* and a guide piece 31*h*. The case support part 31*g* is formed in a protruded shape at an end part of the ice detecting shaft 31 and is turnably supported by a receiving hole (not shown) formed in the case member 9*b*. The lever connecting part 31*f* is formed at the other end part of the ice detecting shaft 31 so as to protrude the outside of the unit case 9 and a supporting point part of the ice detecting member 3 is fitted into the lever connecting part 31*f*. The ice detecting shaft 31 is turnably positioned within the unit case 9 by means of that the case support part 31*g* is inserted into the receiving hole first, a coil spring 32 is engaged with the spring engagement part 31*c* and, in a state that the engagement protruded part 31*a* is pressed against the cam face 28 for ice detecting shaft of the cam wheel 10, a lever connecting part 31*f* side is placed within the unit case 9. The engagement protruded part 31*a* is protruded on an outer side in a radial direction from an outer peripheral face of the ice detecting shaft 31 in the vicinity of the case support part 31*g* of the ice detecting shaft 31 and formed in a curved shape from its midway position. The engagement protruded part 31*a* is formed as a cam follower which is abutted with the cam face 28 for ice detecting shaft formed on the cam wheel 10. Similarly, the engagement piece 31*b* is capable of abutting with the turning preventing piece of the friction member 8 in the vicinity of the end part of the ice detecting shaft 31. The guide piece 31*h* is inserted into a guide groove (not shown) which is formed on a backside portion of a top plate of the case member 9*a* and the guide piece 31*h* is moved along the guide groove. The guide piece 31*h* restricts a turning range of the ice detecting shaft 31.

As shown in FIGS. 4 and 5, the pressing member 41 is turnably supported by "U"-shaped grooves 53*a* formed on upper end portions of two end plates 53 which are stood from the bottom face of the case member 9*b*. The pressing member 41 is, as shown in FIG. 9, formed so that a protruded part 41*c* is protruded from a protruded arm part 41*b* when viewed in a side face direction. The protruded arm part 41*b* is urged by the coil spring 44. The protruded arm part 41*b* is located in the vicinity of the switch-pressing operation preventing piece 31*d* provided in the ice detecting shaft 31 and, in a state that the switch-pressing operation preventing piece 31*d* is abutted with the protruded arm part 41*b*, the pressing member 41 is unable to be turned down.

A button 42*a* of the push switch 42 is disposed at a facing position to the protruded arm part 41*b*. Further, a chevron-shaped protruded part 41*c* is formed on a face of the protruded arm part 41*b* of the pressing member 41 on a side which is not faced to the push switch 42 and the protruded part 41*c* is inserted into an end portion of the coil spring 44. The other end of the coil spring 44 is, as shown in FIG. 5, disposed within an engagement tube 21*c* which is provided in the case member 9*a*, and a shaft (not shown) provided within the engagement tube 21*c* is inserted into the other end of the coil spring 44.

A center part of the pressing member 41 is formed as a turning support part 41*d* for supporting when the pressing member 41 is turned, and both ends of the turning support part 41*d* are located at the respective "U"-shaped grooves 53*a* to be capable of being turned with the turning support part 41*d* as a turning center. The pressing member 41 is provided with a turning restricting part 41*e* and, even when a force in the circumferential direction is applied to the cam abutting part 41*a* from the cam wheel 10, end faces of the turning restricting part 41*e* are restricted by inner walls of the end plates 53. Therefore, one side of the turning support part 41*d* of the pressing member 41 is not floated from the bottom part of the "U"-shaped groove 53*a* to cause to be inclined and thus the pressing member 41 is accurately operated along the cam face 29 for pressing member without displacing its turning center.

Figure 10A:
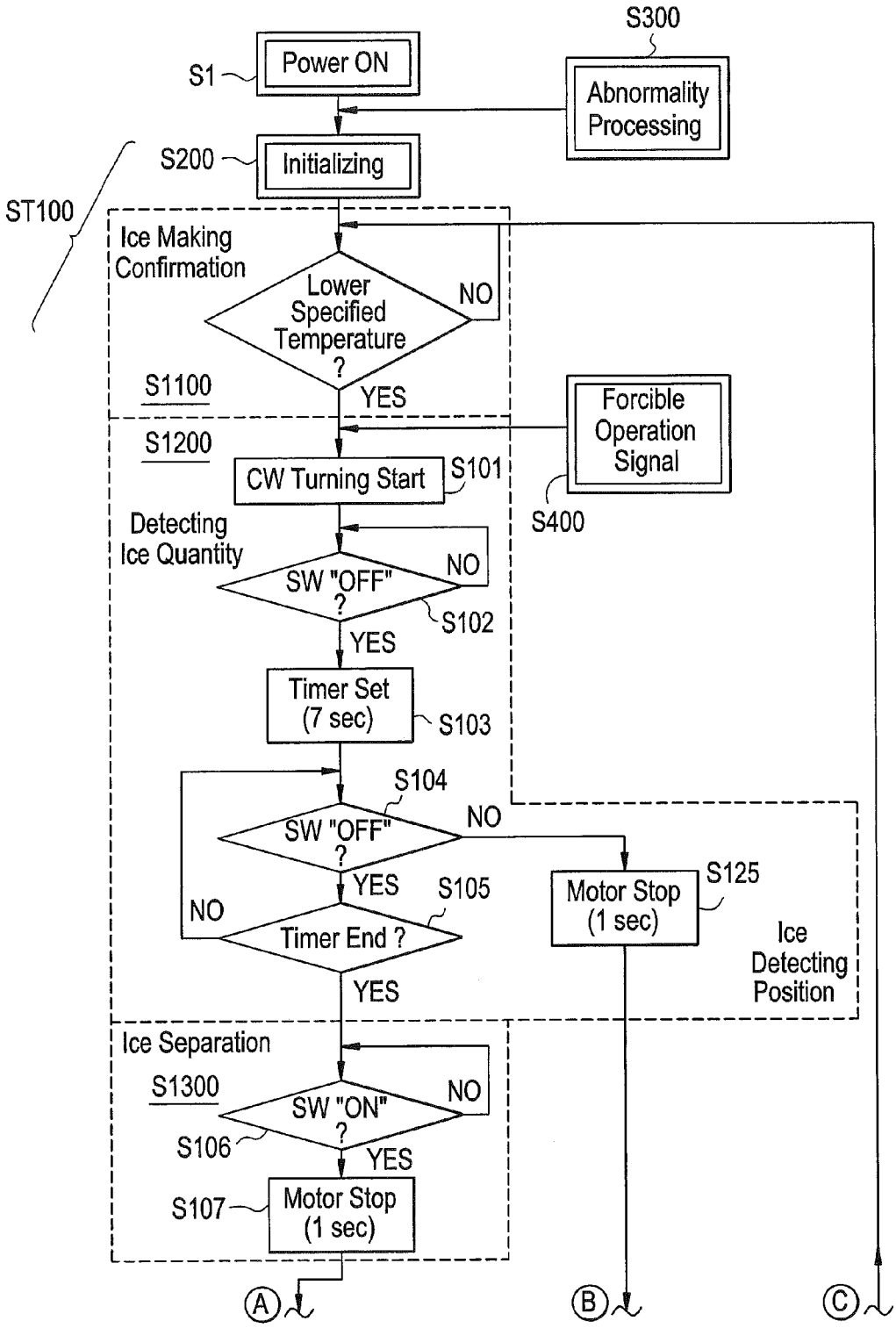
FIGS. 10A and 10B are a flow chart showing specific contents of a basic operation which is executed in a drive unit for an automatic ice maker in accordance with an embodiment of the present invention.
Figure 10B:
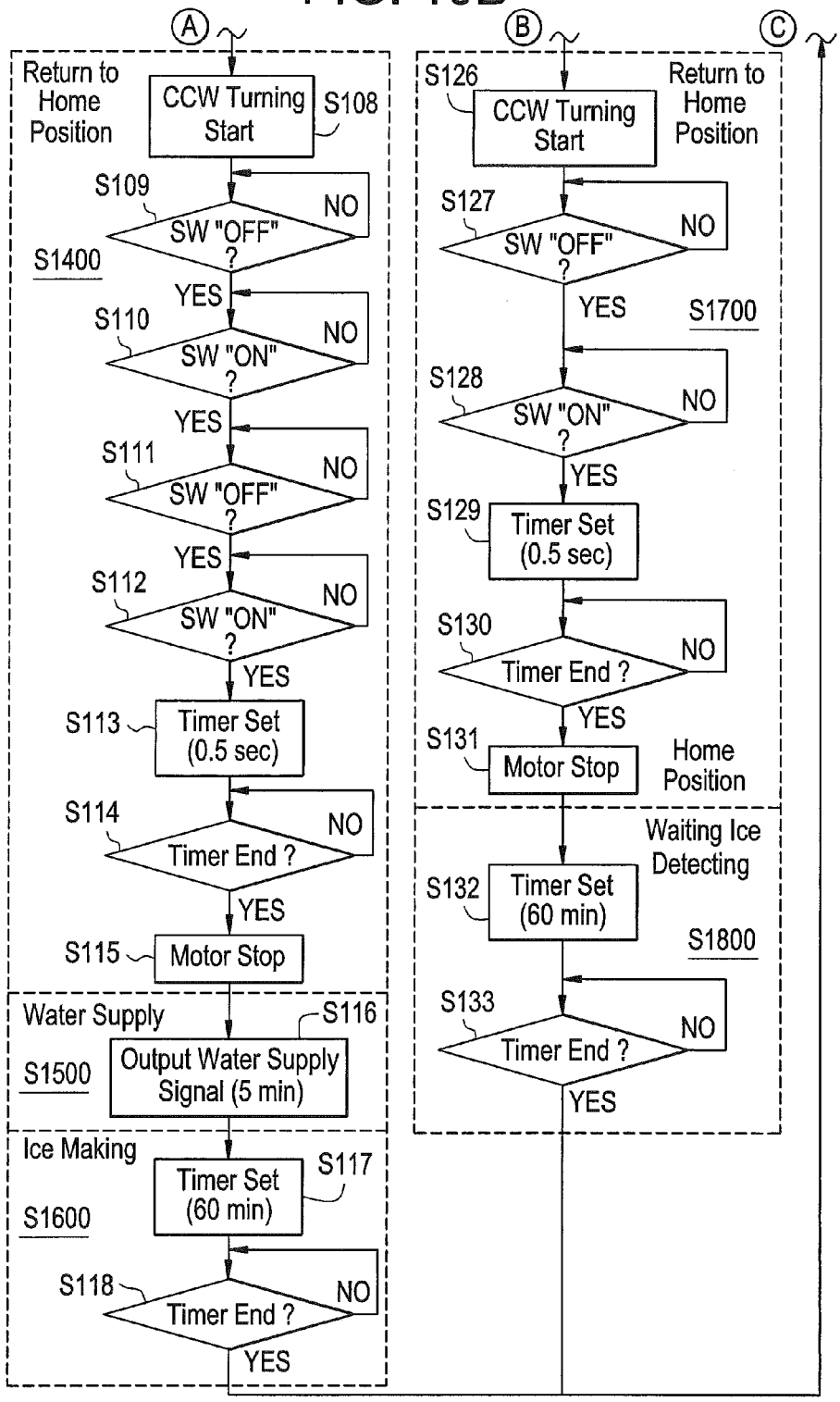

FIGS. 10A and 10B are a flow chart showing specific contents of a basic operation which is performed in a drive unit of an automatic ice maker to which the present invention is applied.

The control section 6 shown in FIG. 2 appropriately executes a basic operation program and an initial setting program to realize the operation which is described with reference to FIG. 3. In this embodiment, when the basic operation program is not being executed, the cam wheel 10 is located at the ice making position and, in this state, the ice tray 2 is held horizontally and the ice detecting member 3 is located on a lateral side of the ice tray 2.

Next, the basic operation of the automatic ice maker 1 will be described below on the basis of the basic operation program shown in FIGS. 10A and 10B. The basic operation is executed when confirmed that ice pieces have been made in the ice tray 2 in a state that the door of the refrigerator is closed.

First, when a power supply of the automatic ice maker 1 is turned on in the step "S1", in the automatic ice maker 1, first, the initialize step is executed in the step "S200" and, after that, the basic operation of the step "S100" is executed. In the ice making confirming step in the step "S1100" of the basic operation, it is judged whether or not the ice tray 2 has reached to a predetermined temperature or lower, more specifically, −10° C. or lower, on the basis of a signal outputted from the thermistor 7. In the ice making confirming step, when the ice tray 2 has reached to −10° C. or lower, it is judged that ice making has completed and then the ice detecting step of the step "S1200" will be executed.

In the ice detecting step of the step "S1200", the ice detecting member 3 is driven by the motor 13 to perform an ice detecting operation for judging whether or not a sufficient quantity of ice pieces is stored in the ice storage part 20. In the ice detecting operation, first, in the step "S101", the motor 13 is normally rotated to turn the cam wheel 10 in a clockwise direction "CW". Next, in the step "S102", the control section 6 judges whether a position detection signal is in an "OFF" state or not, and the step "S102" is repeatedly executed until an "OFF" state is detected. During a state that an "ON" state is detected instead of detecting an "OFF" state, the cam wheel 10 is not turned enough yet from the ice making position. Next, when the cam wheel 10 is turned enough in the clockwise direction "CW", since the position detection signal is changed from the "ON" state to an "OFF" state, the control section 6 sets a predetermined time period in a timer in the step "S103". The time period is set to be sufficiently longer than a time period that the control section 6 requires to detect a quantity of stored ice pieces in the ice storage part 20. When an ice detecting position signal ("OFF" signal) is not detected until the time period has passed, it is judged that a quantity of the stored ice pieces in the ice storage part 20 is insufficient. In other words, when the cam wheel 10 is turned in the clockwise direction "CW", in a case that a quantity of stored ice pieces in the ice storage part 20 is insufficient, the ice detecting member 3 is moved down to a predetermined position without being obstructed by ice pieces in the ice storage part 20. However, in a case that sufficient ice pieces are stored in the ice storage part 20, the ice detecting member 3 is obstructed by ice pieces stored in the ice storage part 20 and thus the position detection signal maintains the "ON" state. In this embodiment, the time period is set to seven seconds.

In the steps "S104" and "S105", when the position detection signal is in the "OFF" state during the time period which is set as described above, the ice separation operating step of the step "S1300" is executed. On the other hand, when the position detection signal is turned to an "ON" state during the time period which is set, a home position returning step (step S1700) and an ice detection waiting step (step S1800) are executed.

In the ice separation operating step of the step "S1300", it is judged whether or not the position detection signal is changed from the "OFF" state to an "ON" state in the step "S106" and, when the position detection signal is turned to an "ON" state, the motor 13 is stopped for one second in the step "S107". The "ON" signal when the position detection signal is switched to the "ON" state from the "OFF" state is an ice separating position signal. In this state, the ice tray 2 is twisted and deformed and thus ice pieces are separated from the ice tray 2 to be dropped into the ice storage part 20.

Next, a home position returning step (step S1400) is executed. In the home position returning step, first, the motor 13 is rotated in the reverse direction to turn the cam wheel 10 in the counter-clockwise direction "CCW" in the step "S108". Next, it is judged that whether or not the position detection signal is changed from the "ON" state to an "OFF" state in the step "S109". As long as the position detection signal is in the "ON" state, the cam wheel 10 is not reached to a position sufficiently separated from the ice separating position. Therefore, the control section 6 repeatedly executes the step "S109" until an "OFF" state is detected. Next, it is judged whether or not the position detection signal is changed from the "OFF" state to an "ON" state in the step "S110". The step "S110" is repeatedly executed until the position detection signal is changed to an "ON" state. When the cam wheel 10 is further turned in the counter-clockwise direction "CCW" to return to a predetermined angular position, the position detection signal is changed from the "ON" state to an "OFF" state. Therefore, since the judging result of the step "S111" is turned to "YES", the control section 6 executes the step "S112". In the step "S112", it is judged whether or not the position detection signal is changed from the "OFF" state to an "ON" state. The step "S112" is repeatedly executed until the control section 6 detects an "ON" signal. In other words, when the cam wheel 10 turned in the counter-clockwise direction "CCW" is returned to the ice making position, the position detection signal is changed from the "OFF" state to an "ON" state. Next, a timer is set to 0.5 second in the step "S113" and, when it is judged that the set time period has passed in the step "S114", the motor 13 is stopped in the step "S115". In this state, the ice tray 2 which is empty has been returned to a horizontal state.

Next, in a water-supply step of the step "S1500", the control section 6 makes a water-supply pump 11 operate to supply water to the ice tray 2 in the step "S116".

Next, in an ice making step of the step "S1600", a timer is set to 60 minutes in the step "S117" and, when 60 minutes have passed in the step "S118", the flow is returned to the ice making confirming step of the step "S1100".

In this embodiment, when a quantity of stored ice pieces in the ice storage part 20 is detected to be sufficient in the ice detecting step of the step "S1200", the ice tray 2 is not required to be reversed to perform an ice separating operation and the ice tray 2 is immediately returned to the ice making position. Therefore, after the motor 13 is stopped for one second in the step "S125", the home position returning step of the step "S1700" is executed. In the home position returning step, first, the motor 13 is rotated in the reverse direction to turn the cam wheel 10 in the counter-clockwise direction "CCW" in the step "S126". Next, after the position detection signal is confirmed to be changed in an "OFF" state in the step "S127" and, after the position detection signal is confirmed to be changed in an "ON" state in the step "S128", a timer is set to 0.5 second in the step "S129". Next, when it is confirmed that 0.5 second has passed in the step "S130", the motor 13 is stopped in the step "S131".

Next, in the ice detection waiting step of the step "S1800", a timer is set to 60 minutes in the step "S132" and, when it is confirmed that 60 minutes have passed in the step "S133", the flow is returned to the ice making confirming step of the step "S1100".

Figure 11:
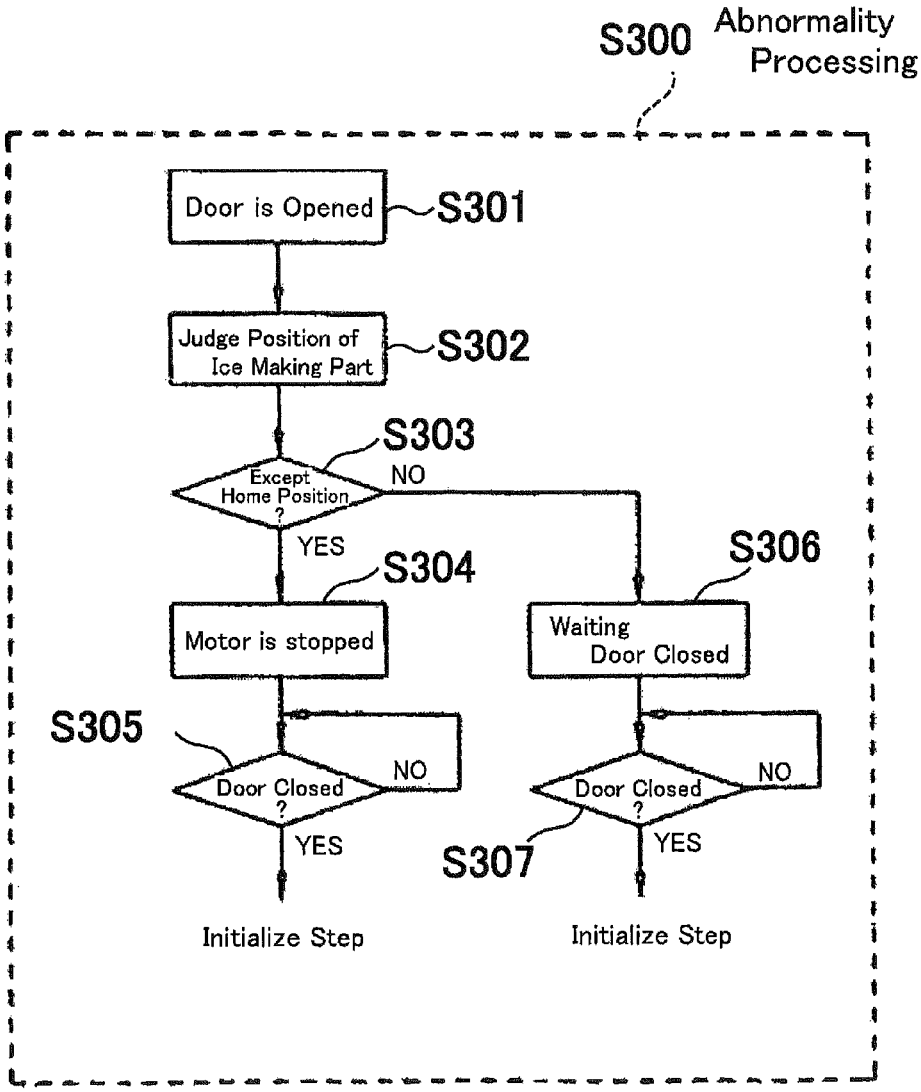
FIG. 11 is a flow chart showing specific contents of an abnormality process which is executed in a drive unit for an automatic ice maker in accordance with an embodiment of the present invention.
Figure 12:
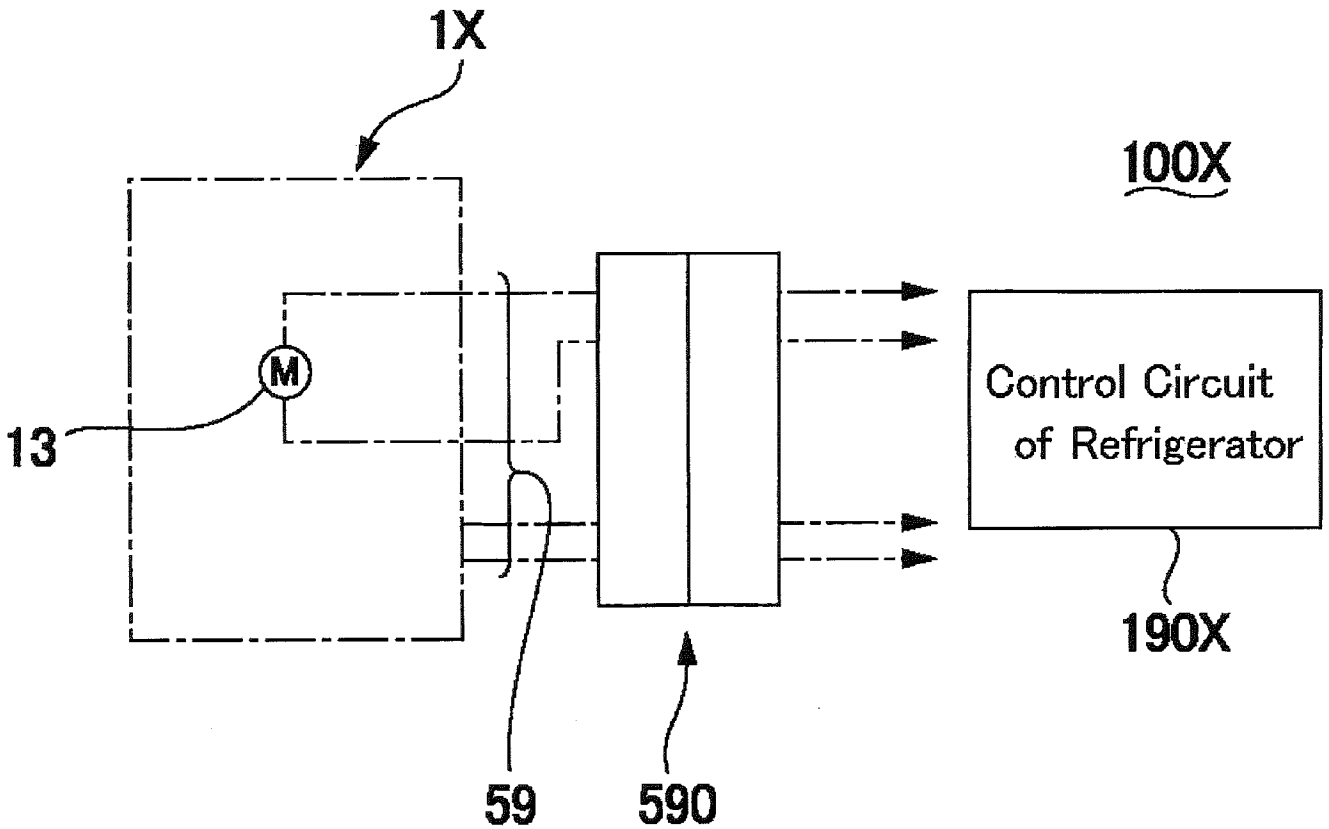
FIG. 12 is an explanatory block diagram showing a conventional automatic ice maker according to the prior art.

FIG. 11 is a flow chart showing specific contents of an abnormality process which is performed in a drive unit of an automatic ice maker to which the present invention is applied.

It is not safe to open the door of the refrigerator and ice pieces are taken out when the basic operation which is described with reference to FIGS. 10A-10B being executed. Therefore, when the door of the refrigerator is opened, a signal outputted from the door switch 150 shown in FIG. 2 is supplied to the automatic ice maker 1 through the control circuit 110 of the refrigerator main body 100 to execute the following abnormality processing step.

In the abnormality processing step, first, when it is confirmed in the step "S301" that the door of the refrigerator has been opened, positions of the respective members in the automatic ice maker 1 are judged in the step "S302". When it is judged that the positions of the respective members are not located at the home position in the step "S303", the motor 13 is stopped in the step "S304" and waits until the door has been closed in the step "S305". Next, when it is judged that the door has been closed in the step "S305", the flow is returned to the initialize step "S200" (see FIGS. 10A and 10B). On the other hand, when it is judged that the positions of the respective members are located at the home position in the step "S303", a waiting state is maintained until the door has been closed in the steps "S306" and "S307" and, when the door has been closed, the abnormality processing step is ended to return to the initialize step (see FIGS. 10A and 10B).

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A drive unit for an automatic ice maker comprising:

a drive part provided with a motor for driving an ice tray and an ice detecting member;

an ice tray position detecting means for detecting a position of the ice tray;

an ice detecting member position detecting means for detecting a position of the ice detecting member;

a control section for controlling drive of the motor on a basis of detection signals of the ice tray position detecting means and the ice detecting member position detecting means; and a unit case in which the control section, the drive part, the ice tray position detecting means and the ice detecting member position detecting means are accommodated;

wherein the drive unit for the automatic ice maker is installed in an ice making compartment of a refrigerator;

wherein a drive voltage and a ground potential are supplied to the drive unit from a refrigerator main body of the refrigerator through a connector provided in the automatic ice maker;

wherein wiring lines connected to a thermistor for detecting a temperature of the ice tray are connected to an inside of the unit case;

wherein the control section, the drive part, the ice tray position detecting means and the ice detecting member position detecting means are electrically connected to each other in the inside of the unit case; and wherein detection signals of the ice trays position detecting means and the ice detecting member position detecting means and a detection signal of the thermistor are inputted into the control section without going through a control circuit of the refrigerator main body, and the motor is controlled by the control section.

2. The drive unit for an automatic ice maker according to claim 1, wherein wiring lines which are connected to a liquid supply device for supplying liquid to the ice tray are connected to the control section disposed in the unit case, and the control section directly controls the liquid supply device without going through a control circuit of the refrigerator main body.

3. The drive unit for an automatic ice maker according to claim 1, wherein the drive part comprises:

a cam wheel which is to be connected to the ice tray for reversing the ice tray;

an ice detecting shaft which is operated by the cam wheel to operate the ice detecting member; and a drive gear train which is connected with the motor for driving the cam wheel and the ice detecting shaft, the ice tray position detecting means and the ice detecting member position detecting means comprise a push switch which is operated by the cam wheel, the cam wheel, the ice detecting shaft, the drive gear train, the motor and the push switch are accommodated within the unit case, and a circuit board with which the motor and terminals of the push switch are connected is also accommodated within the unit case, and the circuit board is provided with the control section.

4. The drive unit for an automatic ice maker according to claim 3, wherein the automatic ice maker is installed in an ice making compartment of a refrigerator, the automatic ice maker is provided with a thermistor for detecting a temperature of the ice tray, wiring lines which are connected to the thermistor are connected to the control section provided in circuit board within the unit case, a signal of the push switch and a detection signal of the thermistor are inputted into the control section without going through a control circuit of a refrigerator main body of the refrigerator, and the motor is controlled by the control section.

5. The drive unit for an automatic ice maker according to claim 4, wherein wiring lines which are connected to a liquid supply device for supplying liquid to the ice tray are connected to the control section which is provided in the circuit board within the unit case, and the control section directly controls the liquid supply device without going through a control circuit of the refrigerator main body.

* * * * *